US012281651B2

(12) United States Patent
Hong

(10) Patent No.: US 12,281,651 B2
(45) Date of Patent: Apr. 22, 2025

(54) ELECTRIC PUMP

(71) Applicant: LG INNOTEK CO., LTD., Seoul (KR)

(72) Inventor: Hoon Ki Hong, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 18/247,977

(22) PCT Filed: Oct. 6, 2021

(86) PCT No.: PCT/KR2021/013665
§ 371 (c)(1),
(2) Date: Apr. 5, 2023

(87) PCT Pub. No.: WO2022/075729
PCT Pub. Date: Apr. 14, 2022

(65) Prior Publication Data

US 2023/0374983 A1 Nov. 23, 2023

(30) Foreign Application Priority Data

Oct. 6, 2020 (KR) ..... 10-2020-0128777

(51) Int. Cl.
*F04C 2/10* (2006.01)
*F04C 11/00* (2006.01)

(52) U.S. Cl.
CPC ..... *F04C 2/10* (2013.01); *F04C 2/102* (2013.01); *F04C 11/008* (2013.01);
(Continued)

(58) Field of Classification Search
CPC ..... F04C 11/008; F04C 15/008; F04C 2/102; F04C 2240/40; F04C 2/10; F04C 2240/10; F04C 2240/30
See application file for complete search history.

(56) References Cited

U.S. PATENT DOCUMENTS 5,219,276 A * 6/1993 Metzner ..... F04C 15/008 417/423.7
8,449,269 B2 5/2013 Yamamori et al.
2010/0290934 A1 11/2010 Hadar et al.

FOREIGN PATENT DOCUMENTS

DE 10 2006 037 177 A1 2/2008
IT UB20159726 A1 6/2017
(Continued)

OTHER PUBLICATIONS

Supplementary European Search Report dated Mar. 5, 2024 in European Application No. 21877980.9.
(Continued)

*Primary Examiner* — Peter J Bertheaud
(74) *Attorney, Agent, or Firm* — Saliwanchik, Lloyd & Eisenschenk

(57) ABSTRACT

The present invention provides an electric pump including a housing, a gear part disposed in the housing, a stator disposed to correspond to the gear part, and a support member disposed between the gear part and the housing, wherein the gear part includes a first gear, a second gear disposed to correspond to the first gear, and a magnet disposed on the second gear, and the support member includes a first region supporting the first gear and a second region protruding from the first region and inserted into the first gear.

7 Claims, 15 Drawing Sheets

(52) U.S. Cl.
CPC ..... *F04C 2240/10* (2013.01); *F04C 2240/30* (2013.01); *F04C 2240/40* (2013.01)

(56) References Cited

FOREIGN PATENT DOCUMENTS

| | | | |
|---|---|---|---|
| IT | 201800006043 | A1 | 12/2019 |
| JP | 8-242569 | A | 9/1996 |
| KR | 10-2014-0145490 | A | 12/2014 |
| KR | 10-2015-0081784 | A | 7/2015 |
| KR | 10-2019-0030889 | A | 3/2019 |

OTHER PUBLICATIONS

International Search Report dated Dec. 22, 2021 in International Application No. PCT/KR2021/013665.

* cited by examiner

ELECTRIC PUMP

CROSS-REFERENCE TO RELATED APPLICATIONS

This application is the U.S. national stage application of International Patent Application No. PCT/KR2021/013665, filed Oct. 6, 2021, which claims the benefit under 35 U.S.C. § 119 of Korean Application No. 10-2020-0128777, filed Oct. 6, 2020, the disclosures of each of which are incorporated herein by reference in their entirety.

TECHNICAL FIELD

The present invention relates to an electric pump.

BACKGROUND ART

An electric oil pump (EOP) serves to discharge a fluid at a predetermined pressure. Such an oil pump includes a housing, a gear part disposed in the housing, and a motor which drives the gear part. However, the conventional electric oil pump has a problem that a gear part and a motor part are mechanically separate, and thus a length in an axial direction is increased.

In addition, since the housing is formed of a plastic material, thermal deformation may occur due to heat generated from the gear part during operation. Accordingly, there is a problem that an efficiency of the electric oil pump is degraded because a clearance is present between the housing and the gear part or an error between axial centers of a plurality of gears included in the gear part occurs.

Technical Problem

The present invention is directed to providing an oil pump in which a housing is miniaturized, a clearance of a gear part in an axial direction due to thermal deformation of the housing is inhibited, and the gear part is driven stably.

Technical Solution

One aspect of the present invention provides an electric pump including a housing, a gear part disposed in the housing, a stator disposed to correspond to the gear part, and a support member disposed between the gear part and the housing, wherein the gear part includes a first gear, a second gear disposed to correspond to the first gear, and a magnet disposed on the second gear, and the support member includes a first region supporting the first gear and a second region protruding from the first region and inserted into the first gear.

The second region may pass through the first gear.

Another aspect of the present invention provides an electric pump including a housing, a gear part disposed in the housing, a stator disposed to correspond to the gear part, a cover disposed above the gear part, and a support member disposed under the gear part, wherein the support member includes a second region which passes through the gear part in an axial direction and is coupled to the cover.

The housing may be coupled to the cover.

The housing may include a lower surface supporting the gear part and the support member and a sidewall extending upward from the lower surface.

Still another aspect of the present invention provides an electric pump including a mold member, a gear part disposed in the mold member, a stator disposed to correspond to the gear part, and a support member disposed between the gear part and the mold member and formed of a metal material, wherein the gear part includes a first gear, a second gear disposed to correspond to the first gear, and a magnet disposed on the second gear, and at least a part of the support member is disposed between a lower surface of the gear part and one surface of the mold member.

The stator may be embedded in the mold member.

The mold member may include an accommodation portion in which the gear part is disposed, and an upper surface of the mold member may be disposed at a higher level than an upper end of the stator.

The electric pump may include a cover disposed above the gear part, wherein at least a part of the cover may be disposed in the accommodation portion.

Yet another aspect of the present invention provides an electric pump including a housing, a gear part disposed in the housing, a driving part which drives the gear part, and a support member disposed between the gear part and the housing, wherein the gear part includes a first gear and a second gear which rotates to correspond to the first gear, the driving part includes a magnet disposed on the second gear and a coil disposed to correspond to the magnet, and the support member includes a first region coupled to the housing and a second region fixed to the first gear.

The housing may include an accommodation portion in which the gear part is disposed.

The support member may include aluminum.

One region of the support member may pass through the gear part in an axial direction, and another region may support the gear part in the axial direction.

An upper end of the support member may be disposed at a higher level than an upper surface of the gear part.

A maximum diameter of the support member may be greater than or equal to an outer diameter of the gear part.

A through hole in which the support member is disposed may be formed in the gear part, and a protruding part protruding toward an axial center may be formed in an inner circumferential surface in which the through hole is formed.

The support member may include a side surface facing the inner circumferential surface of the gear part in a radial direction, and a part of the side surface of the support member may be in contact with the protruding part, and another part may be spaced apart from the inner circumferential surface of the gear part.

Advantageous Effects

According to the present invention, an electric pump can be stably driven by inhibiting a clearance of a gear part in an axial direction due to thermal deformation of a housing and reducing an error between axial centers of gears included in the gear part.

According to the present invention, a separate motor part can be omitted by providing power necessary for pumping oil using an electrical interaction between a gear part and a stator. Accordingly, a length of an electric pump in an axial direction can be reduced, and thus the electric pump can be miniaturized.

MODES OF THE INVENTION

Hereinafter, exemplary embodiments of the present invention will be described in detail with reference to the accompanying drawings.

A direction parallel to a rotation axis which is a center of a rotational motion of a gear part is referred to as an axial direction, a direction perpendicular to the axial direction is referred to as a radial direction from the rotation axis, and a direction along a circle, which has a radius in the radial direction from a center in the axial direction, is referred to as a circumferential direction.

Figure 1:
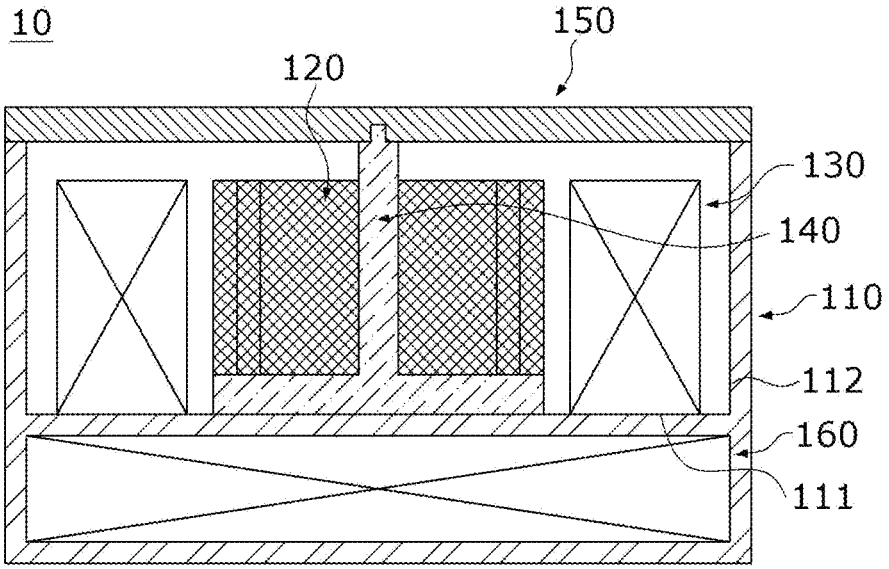
FIG. 1 is a schematic cross-sectional view illustrating an electric pump according to one embodiment of the present invention.

FIG. 1 is a schematic cross-sectional view illustrating an electric pump according to one embodiment of the present invention.

Referring to FIG. 1, an electric pump 10 includes a housing 110, a gear part 120, a stator 130, a support member 140, a cover 150, and a power supply 160.

The housing 110 and the cover 150 may form an exterior of the electric pump 10. The stator 130 and the gear part 120 may be disposed in the housing 110. The housing 110 may be formed of a resin or plastic material.

The housing 110 may include a lower surface 111 and a sidewall 112. In this case, the lower surface 111 may support the stator 130 and the gear part 120 in an axial direction. In addition, the sidewall 112 may surround an outer side of the stator 130. In this case, the gear part 120 may be disposed inside the stator 130.

The gear part 120 rotates through an electrical interaction with the stator 130. The gear part 120 may be disposed to correspond to the stator 130 and disposed the stator 130. The gear part 120 serves to pump a fluid and provides power necessary for pumping.

The stator 130 is disposed to correspond to the gear part 120. A coil for generating a rotating magnetic field is wound around the stator 130 to induce an electrical interaction with the gear part 120 to induce rotation of the gear part 120.

The support member 140 may be disposed between the gear part 120 and the housing 110. In this case, the support member 140 may be fixed to a lower surface 101. In addition, an end portion of the support member 140 may pass through the gear part 120 and may be coupled to the cover 150. The support member 140 may be formed of a metal material. The support member 140 may rub against the lower surface of the gear part 120 while the gear part 120 rotates. The support member 140 may reduce rotational friction of the gear part 120 and inhibit a clearance of the gear part 120 in the axial direction. In addition, one side of the support member 140 may pass through the gear part 120 in the axial direction to fix a rotating center of the gear part 120.

The cover 150 may be disposed above the gear part 120. The cover 150 may be coupled to the housing 110. The cover 150 may be formed of a metal material. In this case, the cover 150 may be formed of the same material as the support member 140. The cover 150 may include aluminum.

The power supply 160 may be disposed at one side of the housing 110. In addition, the power supply 160 may be electrically connected to the stator 130 to supply a current to the stator 130. The power supply 160 may include a printed circuit board and electronic components mounted on the printed circuit board.

Figure 2:
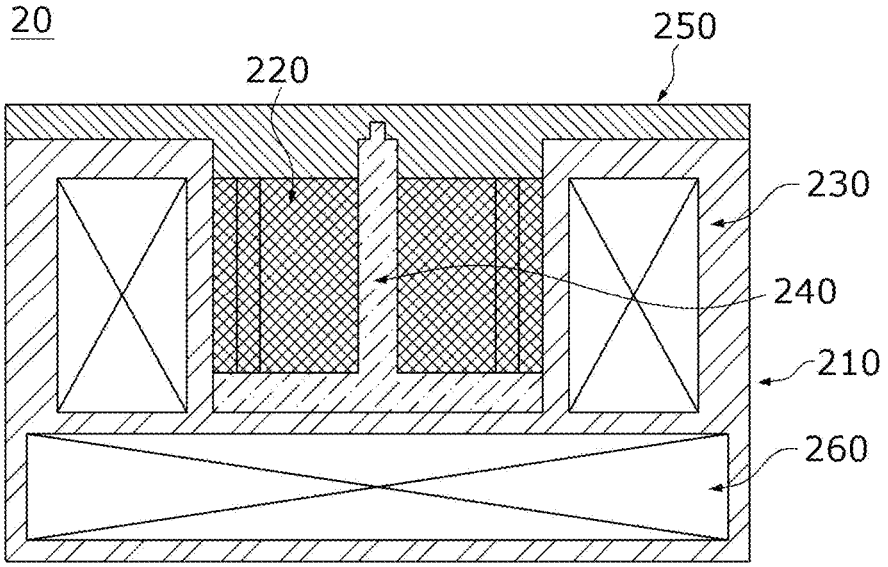
FIG. 2 is a schematic cross-sectional view illustrating an electric pump according to another embodiment of the present invention.
Figure 3:
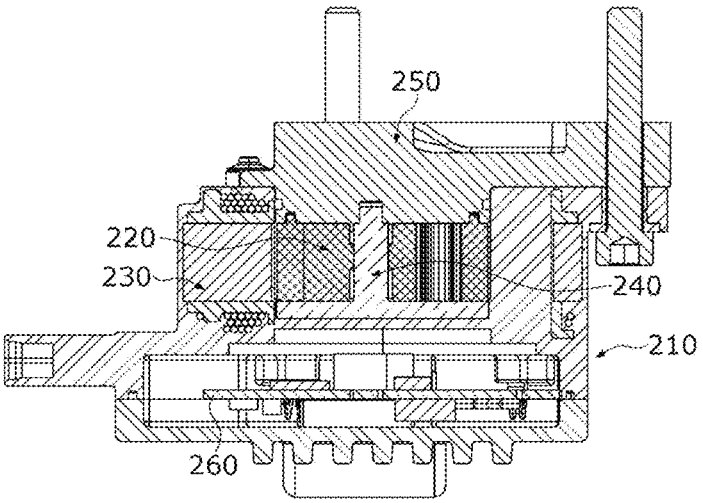
FIG. 3 is a cross-sectional view illustrating the electric pump according to another embodiment of the present invention.
Figure 4:
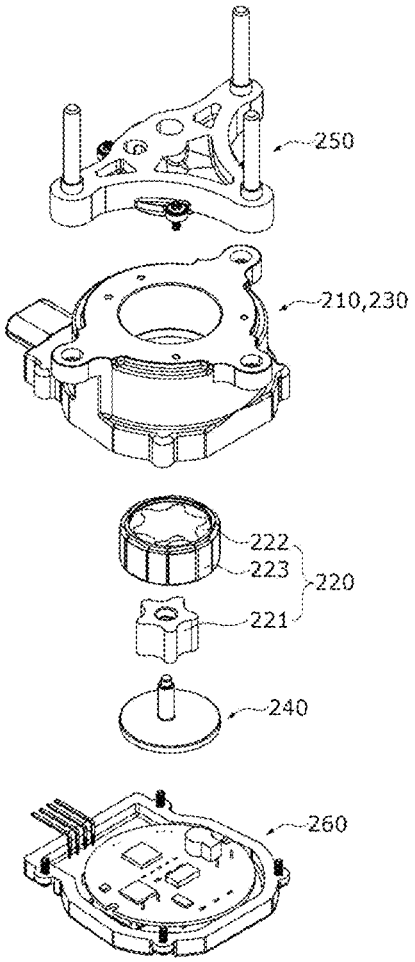
FIG. 4 is an exploded perspective view illustrating the electric pump according to another embodiment of the present invention.

FIG. 2 is a schematic cross-sectional view illustrating an electric pump according to another embodiment of the present invention, FIG. 3 is a cross-sectional view illustrating the electric pump according to another embodiment of the present invention, and FIG. 4 is an exploded perspective view illustrating the electric pump according to another embodiment of the present invention.

Referring to FIGS. 2 to 4, an electric pump 20 may include a mold member 210, a gear part 220, a stator 230, a support member 240, a cover 250, and a power supply 260.

The mold member 210 covers the stator 230. In this case, the mold member 210 may be injection-molded into the stator 230. In addition, the mold member 210 may include an accommodation portion therein. The gear part 220 is disposed in the accommodation portion. The accommodation portion may have a cylindrical shape. A diameter of the accommodation portion may be greater than an outer diameter of the gear part 220.

The gear part 220 may be disposed in the accommodation portion of the mold member 210. In addition, the gear part 220 may include a first gear 221, a second gear 222, and a magnet 223. The second gear 222 is disposed outside the first gear 221. In addition, the magnet 223 may be disposed on an outer circumferential surface of the second gear 222. The magnet 223 may be provided as a plurality of magnets 223. The magnets 223 may be disposed in a circumferential direction.

The stator 230 is disposed in the mold member 210. In addition, the stator 230 is disposed to correspond to the gear part 220. The stator 230 is electrically connected to the power supply 260, and when a current is supplied from the power supply 260, an electrical interaction with the magnet 223 may be induced.

The support member 240 is disposed between the gear part 220 and the mold member 210. One surface of the support member 240 is in contact with the mold member 210. In this case, one surface of the support member 240 may be fixed to the mold member 210. An end portion of the support member 240 may pass through the gear part 220. In addition, the end portion of the support member 240 may be coupled to the cover 250. The support member 240 may be formed of a metal material. The support member 240 may slide with respect to the gear part 220 when the gear part 220 is driven by an electrical interaction between the stator 230 and the gear part 220. The support member 240 is formed of the metal material and has excellent sliding properties with respect to the gear part 220. In addition, a clearance in an axial direction between the gear part 220 and the mold member 210 may be inhibited. In addition, the support member 240 fixes a rotating center of the gear part 220, and thus the gear part 220 can be driven more stably.

The cover 250 may be disposed above the gear part 220 and coupled to an upper end of the mold member 210. The cover 250 may be formed of a metal material. The cover 250 may include a suction port (not shown) and a discharge port (not shown). The suction port (not shown) and the discharge port (not shown) may guide a fluid to be smoothly sucked and discharged by the gear part 220.

The power supply 260 may be disposed at one side of the mold member 210. In addition, the power supply 260 may be electrically connected to the stator 230 to supply a current to the stator 230. The power supply 260 may include a printed circuit board and electronic components mounted on the printed circuit board.

Figure 5:
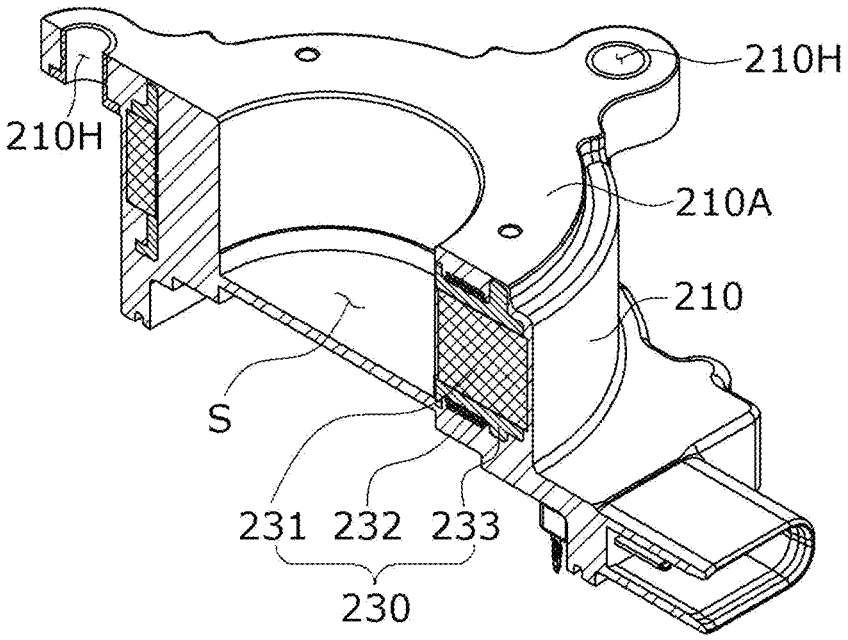
FIG. 5 is a cross-sectional perspective view illustrating a cross section of a mold member and a stator.

FIG. 5 is a cross-sectional perspective view illustrating a cross section of the mold member and the stator.

Referring to FIG. 5, the stator 230 may include a stator core 231, a coil 232 wound around the stator core 231, and an insulator 233 disposed between the stator core 231 and the coil 232. In this case, the coil 232 may be connected to the power supply 260. The stator 230 is embedded in the mold member 210.

The mold member 210 may cover the stator core 231, the coil 232, and the insulator 233. In this case, the mold member 210 may be coupled to the stator 230 in an injection manner. An insert injection manner may be used as the injection manner. In this case, the mold member 210 may be formed of a resin or plastic material. For example, the mold member 210 may be formed of a thermally conductive plastic material. The thermally conductive plastic material may include a pellet type resin, a heat dissipation resin, a polyphtalamide (PPA) resin, carbon nanotubes (CNTs), or the like.

The cover 250 may be disposed on an upper surface 210A of the mold member 210. In this case, the upper surface 210A of the mold member 210 may be disposed at a higher level than an upper end of the stator 230. In addition, at least one fastening hole 210H may be formed in the upper surface 210A of the mold member 210. In addition, a screw thread for coupling with a fastening member may be formed in the fastening hole 210H. In this case, the fastening hole 210H may be coupled to the cover 250 by the fastening member.

The mold member 210 may form an accommodation portion S. The gear part 220 may be disposed in the accommodation portion S. The accommodation portion S may have a cylindrical shape. A length of the accommodation portion S in the axial direction may be greater than a length of the gear part 220 in the axial direction. In addition, the diameter of the accommodation portion S may be larger than the outer diameter of the gear part 220.

In addition, an upper side of the accommodation portion S may be closed by the cover 250.

An edge of the cover 250 is coupled to the upper surface 210A of the mold member 210. A central portion of the cover 250 may protrude toward the gear part 220 and be disposed in the accommodation portion S. In this case, the central portion of the cover 250 may fix an upper end of the gear part 220. In addition, the accommodation portion S may be connected to the suction port (not shown) and the discharge port (not shown) of the cover 250. In this case, the suction port (not shown) and the discharge port (not shown) may be formed to be spatially partitioned.

Figure 6:
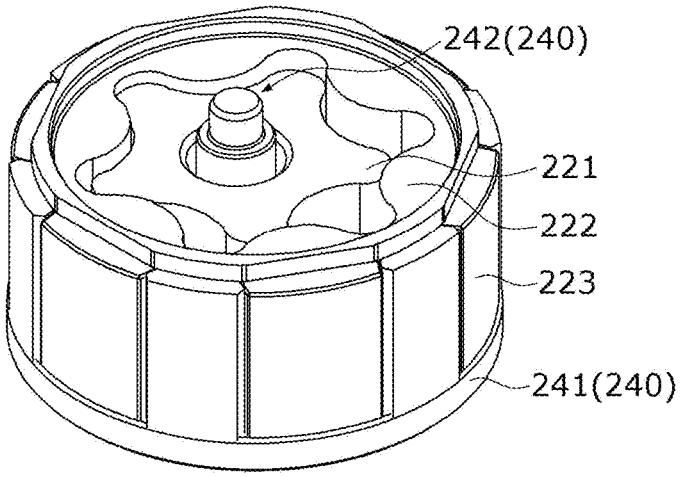
FIG. 6 is a perspective view illustrating a state in which a gear part and a support member are coupled.
Figure 7:
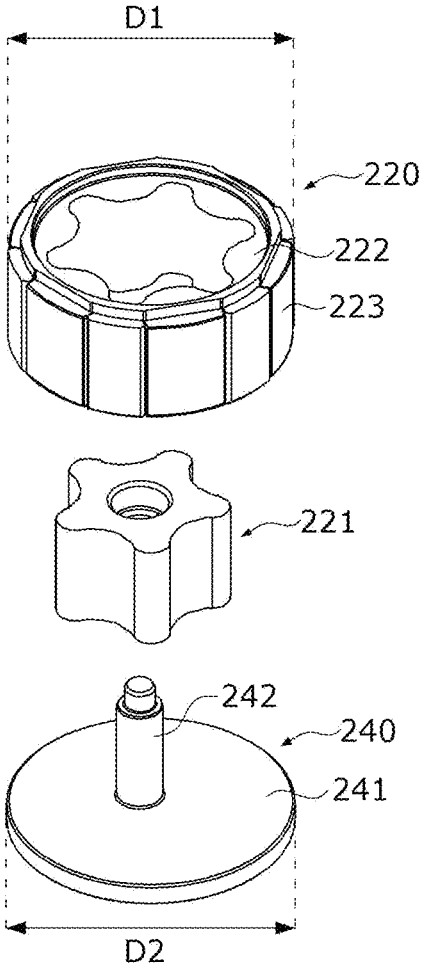
FIG. 7 is an exploded perspective view illustrating a first gear, a second gear, and the support member.
Figure 8:
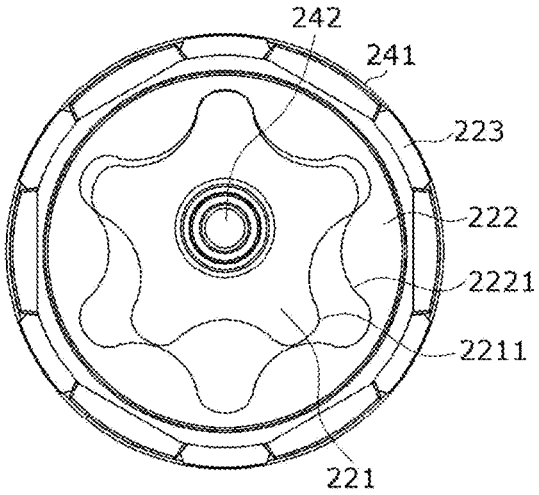
FIG. 8 is a plan view illustrating a state in which the gear part and the support member are coupled.

FIG. 6 is a perspective view illustrating a state in which the gear part and the support member are coupled, FIG. 7 is an exploded perspective view illustrating the first gear, the second gear, and the support member, and FIG. 8 is a plan view illustrating a state in which the gear part and the support member are coupled.

Although the present embodiment has been described with reference to the gear part 220 and the support member 240 illustrated in FIG. 3 for the sake of convenience of description, shapes and functions of the gear part 220 and the support member 240 described in the present embodiment may also be applied to the gear part 120 and the support member 140 shown in FIGS. 1 and 6.

Referring to FIG. 6, the support member 240 supports the gear part 220 in the axial direction. In addition, the support member 240 may pass through the gear part 220 and fix the rotating center of the gear part 220. To this end, the support member 240 may include a first region 241 and a second region 242.

The first region 241 is disposed under the gear part 220. In this case, the first region 241 may support a lower surface of the gear part 220. In addition, the first region 241 may be fixed to the mold member 210. The first region 241 may have a disc shape. A diameter D2 of the first region 241 may be greater than or equal to an outer diameter D1 of the gear part 220. Meanwhile, although not illustrated in the drawings, the diameter of the first region may be smaller than the outer diameter of the gear part, and an edge of the gear part may be spaced apart from the mold member.

The second region 242 may protrude from the first region 241. The second region 242 may pass through the first gear 221. In this case, the second region 242 may be disposed at a rotating center of the first gear 221. The second region 242 may be a cylindrical member extending in the axial direction. In this case, a diameter of the second region 242 may be smaller than a diameter of an inner circumferential surface of the first gear 221.

Referring to FIG. 7, the first gear 221 may be disposed inside the second gear 222, and the second region 242 may be disposed inside the first gear 221. The second region 242 may pass through the first gear 221 in the axial direction. In this case, a length of the second region 242 in the axial direction may be greater than a length of the gear part 220 in the axial direction. An end portion of the second region 242 may be disposed at a higher level than an upper surface of the first gear 221. In addition, the end portion of the second region 242 may be coupled to the cover 250.

Referring to FIG. 8, N outer lobes 2211 may be formed on the first gear 221 in a circumferential direction to face outward in a radial direction from an axial center. Meanwhile, N+1 inner lobes 2221 may be formed on the second gear 222 to face inward in the radial direction. In this case, the outer lobes 2211 may be formed to be caught by the inner lobes 2221. As the first gear 221 rotates, the second gear 222 rotates at a rotation ratio of (N+1)/N. The gear part 220 has a predetermined eccentric structure when the first gear 221 rotates. Due to such eccentricity, a space through which a fluid (oil) flows is formed between the first gear 221 and the second gear 222. That is, during a rotational movement of the first gear 221, a portion of which a volume increases suctions a surrounding fluid due to a decrease in pressure, and a portion of which a volume decreases discharges a fluid due to an increase in pressure.

The gear part 220 electrically interacts with the stator 330 to pump the oil and also provide power necessary for pumping. Accordingly, in the electric pump according to the present invention, a length in the axial direction can be reduced by omitting a separate motor part.

Figure 9:
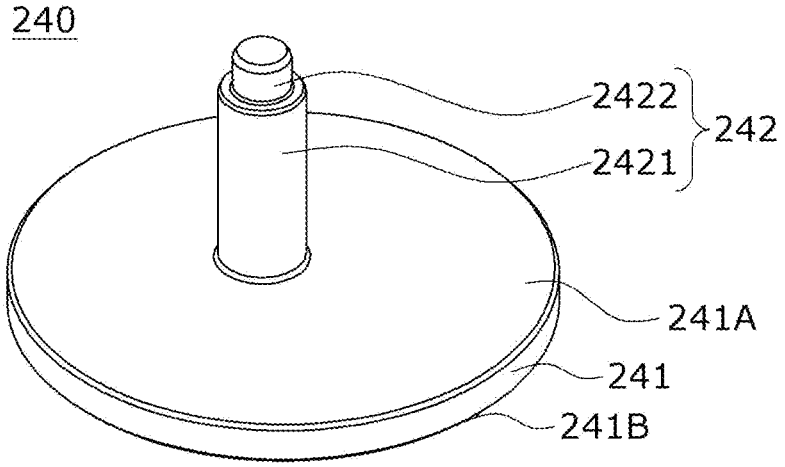
FIG. 9 is a perspective view illustrating the support member.
Figure 10:
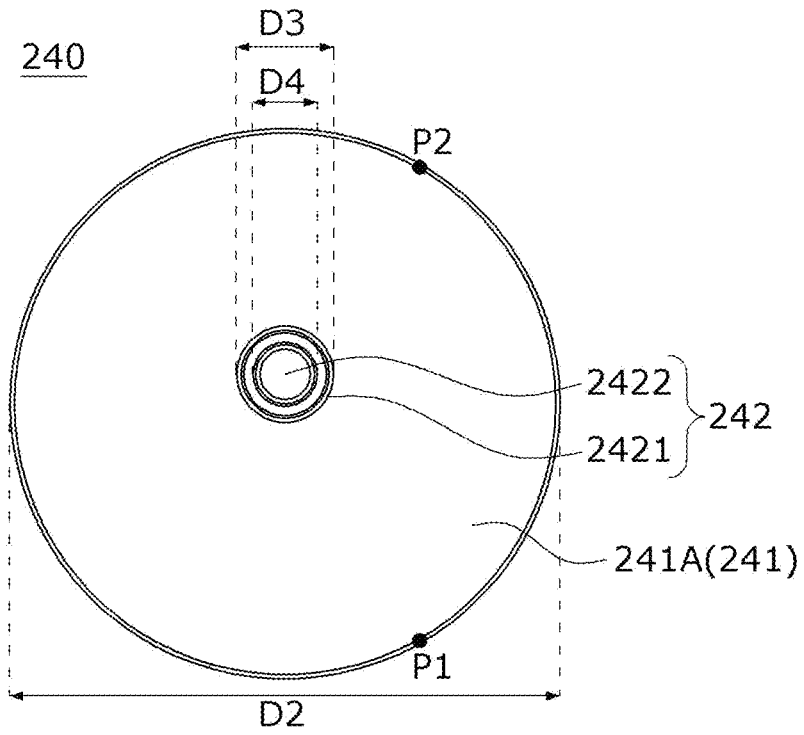
FIG. 10 is a plan view illustrating the support member.
Figure 11:
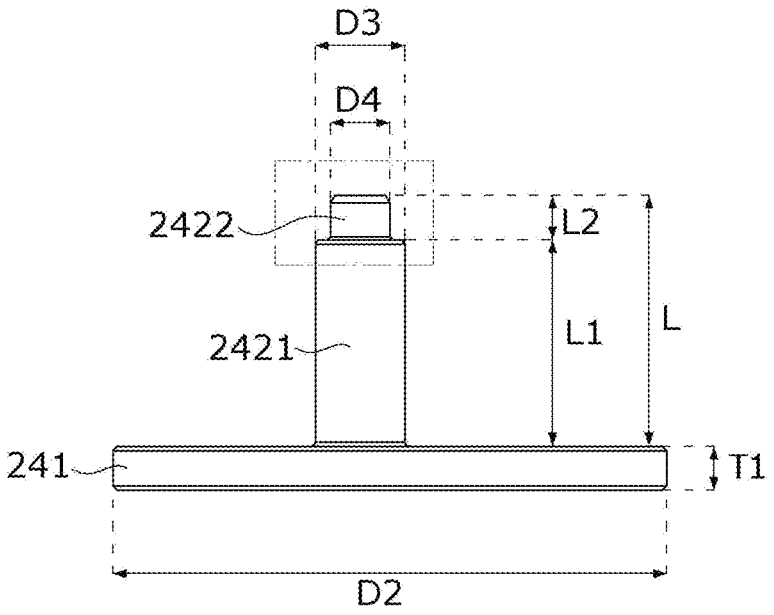
FIG. 11 is a side view illustrating the support member.
Figure 12:
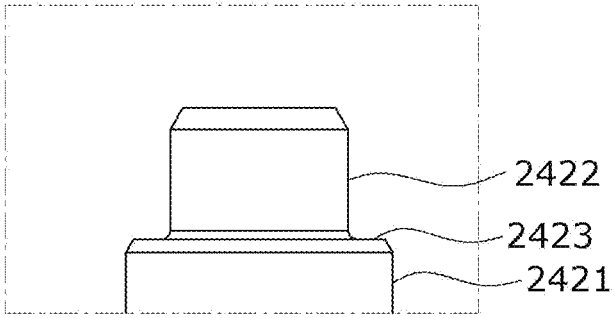
FIG. 12 is an enlarged view illustrating a portion of FIG. 11.

FIG. 9 is a perspective view illustrating the support member, and FIG. 10 is a plan view illustrating the support member. FIG. 11 is a side view illustrating the support member, and FIG. 12 is an enlarged view illustrating a portion of FIG. 11.

Referring to FIG. 9, the support member 240 may include the first region 241 and the second region 242 protruding upward from an upper surface of the first region 241. In this case, the first region 241 and the second region 242 may be integrally formed. The support member 240 may include aluminum. In this case, the cover 250 may be formed of the same material as the support member 240.

The first region 241 may include a first surface 241A and a second surface 241B. The first surface 241A and the second surface 241B may be disposed in the axial direction. In this case, the first surface 241A is disposed toward the gear part 220. In addition, the second surface 241B is disposed toward the mold member 210. The first surface 241A is in contact with the gear part 220, and the second surface 241B is in contact with the mold member 210. In this case, while the gear part 220 rotates, a contact portion between the first surface 241A and the gear part 200 may be rubbed. The diameter D2 of the first region 241 may be greater than or equal to the outer diameter of the gear part 220.

The first region 241 may have the disc shape. In this case, the first region 241 may have a first thickness T1 in the axial direction. In this case, the first thickness T1 may be equal to a value obtained by subtracting a length of the gear part 220 in the axial direction from a distance between the cover 250 and the mold member 210 disposed in the accommodation portion S. In this case, a height of the gear part 220 in the axial direction may be adjusted according to the first thickness T1 of the first region 241. In addition, clearances between the mold member 210, the gear part 220, and the cover 250 disposed in the axial direction can be inhibited by adjusting the first thickness T1 of the first region 241.

The second region 242 extends from the first region 241. The second region 242 may be disposed on the first surface 241A. The second region 242 may be eccentrically disposed with respect to a center of the first surface 241A. A shortest distance from one point P1 of an edge of the first surface 241A to the second region 242 may be different form a shortest distance from another point P2 of an edge of the upper surface of the first region 241 to the second region 242.

The second region 242 may include a first portion 2421 and a second portion 2422. The first portion 2421 may extend from the first region 241. The first portion 2421 may be disposed inside the first gear 221. In this case, a diameter D3 of the first portion 2421 may be smaller than or equal to the diameter of the inner circumferential surface of the first gear 221. As described above, the first portion 2421 may be disposed at a rotation axis which is a center of a rotational motion of the first gear 221 to support a motion of the gear part 220 in a radial direction.

The second portion 2422 may extend from an end portion of the first portion 2421. The second portion 2422 may be disposed above the upper surface of the first gear 221. In addition, the second portion 2422 may be coupled to the cover 250. In this case, a groove corresponding to a shape of the second portion 2422 may be formed in the cover 250, and the second portion 2422 may be disposed in the groove. A diameter D4 of the second portion 2422 may be smaller than the diameter D3 of the first portion 2421. According to the embodiment, a ratio of the diameter of the second portion 2422 to the diameter D3 of the first portion 2421 may be in the range of 0.5 to 0.8. The support member 240 may support a movement of the gear part 220 in the radial direction while the gear part 220 is driven and be coupled to the cover 250 to increase a fixing force.

A length L of the second region 242 in the axial direction is equal to the sum of lengths of the first portion 2421 and the second portion 2422 in the axial direction. In this case, the first portion 2421 may have a first length L1 in the axial direction, and the second portion 2422 may have a second length L2 in the axial direction. In this case, the first length L1 may be greater than the second length L2. According to the embodiment, a ratio of the second length L2 to the first length L1 may be in the range of 0.15 to 0.4.

Meanwhile, according to another embodiment of the present invention, although not illustrated in the drawings, the length L of the second region 242 may be smaller than the length of the gear part 220 in the axial direction. In this case, an upper end of the second region 242 may be disposed at a lower level than an upper surface of the gear part 220. In addition, the upper end of the second region 242 may be spaced apart from the cover 250.

Referring to FIG. 12, an edge of an upper end of the first portion 2421 may be formed to be tapered. In addition, an edge of an upper end of the second portion 2422 may be formed to be tapered. In addition, the second region 242 may include a step 2423 connecting the first portion 2421 and the second portion 2422.

Figure 13:
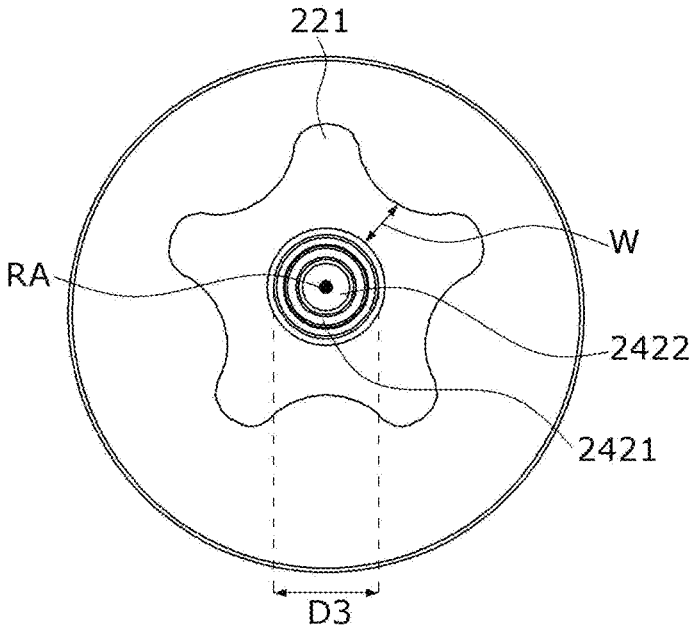
FIG. 13 is a plan view illustrating a state in which the first gear and the support member are coupled.

FIG. 13 is a plan view illustrating a state in which the first gear and the support member are coupled.

Referring to FIG. 13, the first gear 221 may have a first width W which is a minimum width in the radial direction. In this case, the first width W may be a shortest distance between an inner diameter of the first gear 221 and a dedendum circle of the first gear 221. The first width W1 may be smaller than the diameter D3 of the first portion 2421. For example, the first width W1 may be in the range of 2 to 4.5 mm, and the diameter D3 of the first portion 2421 may be in the range of 4.5 to 6.5 mm. In this case, the first width W1 and the diameter D3 of the first portion 2421 may vary according to a size of the electric pump. A ratio of the first width W1 to the diameter D3 of the first portion 2421 may be in the range of 0.3 to 1. In this case, as the ratio of the first width W1 to the diameter D3 of the first portion 2421 decreases, a mechanical strength of the first gear 221 may decrease. Conversely, when the ratio of the first width W1 to the diameter D3 of the first portion 2421 increases, the diameter of the first portion 2421 may not be sufficiently secured, and thus a mechanical strength of the support member 240 may decrease.

Figure 14:
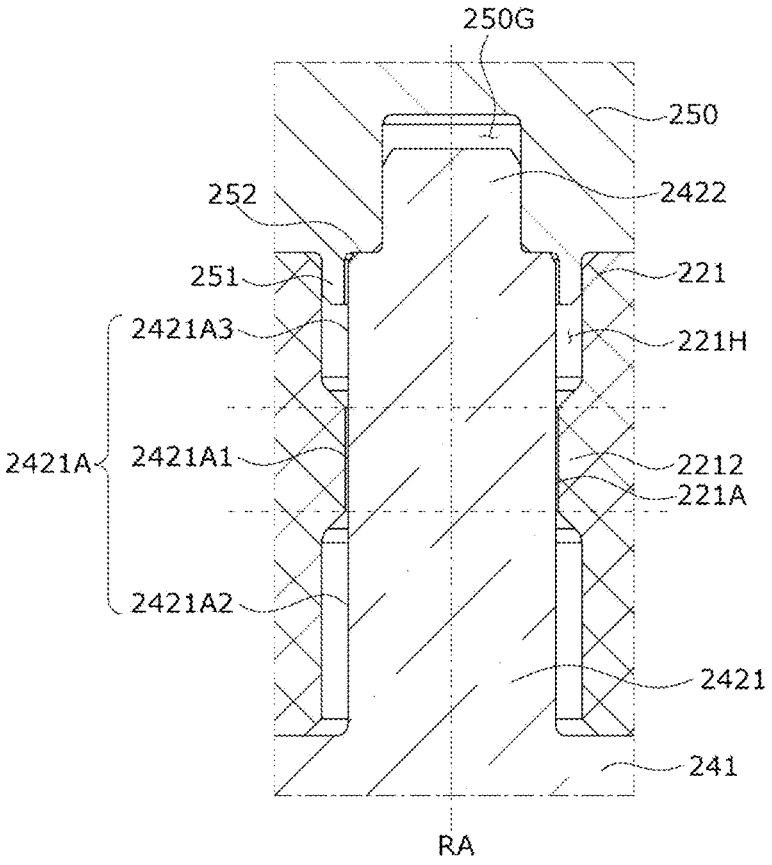
FIG. 14 is a partial cross-sectional view illustrating the electric pump illustrated in FIG. 3.

FIG. 14 is a partial cross-sectional view illustrating the electric pump illustrated in FIG. 3.

Referring to FIG. 14, the first gear 221 may include a lower surface facing the support member 240 and the upper surface facing the cover 250. In addition, a through hole 221H passing through the upper surface and the lower surface may be formed in the first gear 221. In this case, a rotation axis RA which is the center of the rotational motion of the first gear 221 may be disposed in the through hole 221H. In addition, the first portion 2421 may be disposed in the through hole 221H. In this case, the first portion 2421 may include a side surface 2421A facing the inner circumferential surface of the first gear 221. A diameter of the through hole 221H may be greater than the diameter of the first portion 2421, and thus the side surface 2421A may be spaced apart from the inner circumferential surface of the first gear 221.

The first gear 221 may include a protruding part 2212 protruding toward the rotation axis RA. The protruding part 2212 may be disposed on the inner circumferential surface of the first gear 221. In this case, the protruding part 2212 may include a protruding surface 221A in contact with the side surface 2421A of the first portion 2421.

The side surface 2421A of the first portion 2421 may include a first part 2421A1, a second part 2421A2, and a third part 2421A3.

The first part 2421A1 may be in contact with the protruding surface 221A. The first part 2421A1 may be spaced apart from the first region 241. In addition, the second part 2421A2 may be disposed between the first region 241 and the first part 2421A1. In this case, the second part 2421A2 may be spaced apart from the first gear 221. The second part 2421A2 may have a greater length than the first part 2421A1 in the axial direction. In addition, the third part 2421A3 may be disposed between the first part 2421A1 and the second portion 2422. In this case, the third part 2421A3 may be spaced apart from the first gear 221. Meanwhile, the cover 250 may include a protrusion 251 protruding between the third part 2421A3 and the first gears 221. In addition, a groove 250G may be formed inside the protrusion 251 in the cover 250. In this case, the second portion 2422 may be disposed in the groove 250G. A length of the groove 250G in the axial direction may be greater than a length of the second portion 2422 in the axial direction. In this case, the upper end of the second portion 2422 may be spaced apart from the cover 250.

The cover 250 may include a seating surface 250A disposed between the groove 250G and the protrusion 251. In this case, the seating surface 250A may be in contact with the step 2423. As described above, the cover 250 may include a structure for being fixedly coupled to the support member 240 to increase a fixing force of the support member 240.

Figure 15:
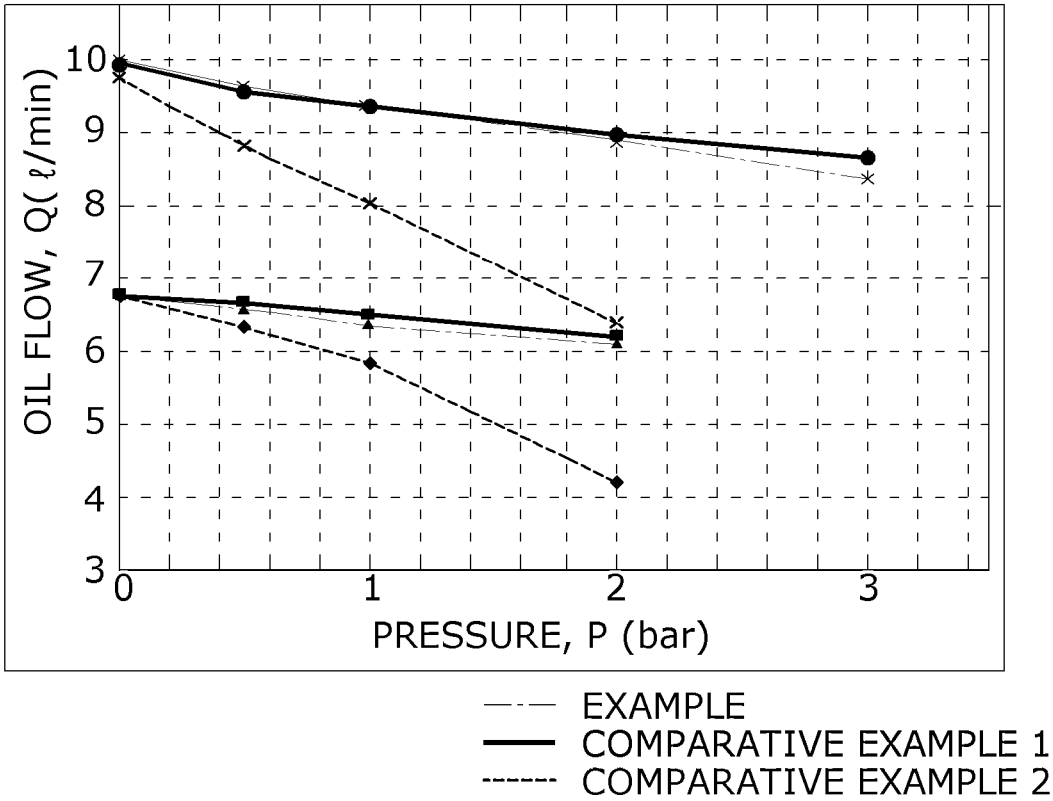
FIG. 15 is a graph showing a comparison between Example and Comparative Examples for a flow rate of oil with respect to a pressure of the oil.

FIG. 15 is a graph showing a comparison between Example and Comparative Examples for a flow rate of oil with respect to a pressure of the oil.

In Example of FIG. 15, a change in flow rate of oil with respect to a pressure of the oil of the electric pump including the housing, the gear part, the stator, the support member, and the cover like the structure of FIG. 3 was measured. The electric pump of Example has a structure in which power is generated through the gear part and the oil is pumped from the gear part.

In Comparative Example 1, a change in flow rate of oil with respect to a pressure of the oil of the conventional electric pump in which the motor part and the pump part were mechanically separated was measured. The electric pump of Comparative Example 1 has a structure in which power generated in the motor part is transmitted to the pump part to operate the pump part.

In Comparative Example 2, a change in flow rate of oil with respect to a pressure of the oil of an electric pump in which the support member in the structure of FIG. 3 was omitted was measured. In this case, the electric pump of Comparative Example 2 may have the same configuration as the electric pump used in Example except that the support member is omitted.

Referring to FIG. 15, it can be seen that, in Comparative Example 2, the flow rate of the oil rapidly decreases as the pressure of the oil increases when compared to Comparative Example 1. Accordingly, it can be seen that, in the electric pump of Comparative Example 2, a value of the flow rate of the oil decreases rapidly according to the pressure of the oil as compared to the convention electric pump in which the motor part and the pump part are mechanically separate. Accordingly, it can be seen that, although the electric pump including the gear part serving as the motor part and the pump part can reduce a length in the axial direction, a hydraulic pressure loss occurs due to a clearance present between the gear part and the housing in the axial direction.

Conversely, in Example, it can be seen that a decrease in the flow rate of the oil is relatively small even when the pressure of the oil increases compared to Comparative Example 2. In this case, it can be seen that a decrease in the flow rate of Example and a decrease in the flow rate of Comparative Example 1 are similar. That is, it can be seen that, while Example has a structure similar to that of Comparative Example 2, there is no significant difference in oil pumping performance between Example and Comparative Example 1. As described above, in the electric pump according to the present invention, the size can be minimized by reducing the length in the axial direction, and the oil pumping performance can be maintained by inhibiting the generation of the clearance between the gear part and the housing in the axial direction.

Embodiments have been described using the examples of the electric pump but are not limited thereto. The embodiments can be used for various devices such as vehicles or home appliances.

The invention claimed is:

1. An electric pump comprising:

a mold member;

a gear part disposed in the mold member;

a stator disposed to correspond to the gear part; and a support member disposed between the gear part and the mold member, wherein the gear part includes a first gear, a second gear disposed to correspond to the first gear, and a magnet disposed on the second gear, wherein the support member includes a first region supporting the first gear and a second region protruding from the first region and inserted into the first gear, wherein the first region supports a lower surface of the gear part, wherein the mold member includes an accommodation portion in which the gear part is disposed, wherein at least a part of the support member is disposed between a lower surface of the gear part and one surface of the mold member, and wherein the stator is embedded in the mold member.

2. The electric pump of claim 1, wherein the second region passes through the first gear.

3. The electric pump of claim 1, comprising a cover disposed above the gear part; and wherein the second region passes through the gear part in an axial direction and is coupled to the cover.

4. The electric pump of claim 3, wherein the mold member is coupled to the cover.

5. The electric pump of claim 4, wherein the mold member includes:

a lower surface supporting the gear part and the support member; and a sidewall extending upward from the lower surface.

6. The electric pump of claim 1, wherein:

an upper surface of the mold member is disposed at a higher level than an upper end of the stator.

7. The electric pump of claim 6, comprising a cover disposed above the gear part, wherein at least a part of the cover is disposed in the accommodation portion.

* * * * *